428-570

1/21/86 SR

OR 4,565,744

United States Patent [19]

Walter et al.

[11] Patent Number: 4,565,744

[45] Date of Patent: Jan. 21, 1986

[54] WETTABLE COATING FOR REINFORCEMENT PARTICLES OF METAL MATRIX COMPOSITE

[75] Inventors: Robert J. Walter, Thousand Oaks; Jerhong Lin, Woodland Hills, both of Calif.

[73] Assignee: Rockwell International Corporation, El Segundo, Calif.

[21] Appl. No.: 556,660

[22] Filed: Nov. 30, 1983

[51] Int. Cl.[4] ..... B22F 3/00

[52] U.S. Cl. ..... 428/570; 423/345; 428/614; 427/381

[58] Field of Search ..... 428/570, 614; 423/345

[56] References Cited

U.S. PATENT DOCUMENTS 4,082,864 4/1978 Kendall et al. ..... 427/248 B 4,134,759 1/1979 Yajima et al. ..... 423/345

*Primary Examiner*—Veronica O'Keefe

*Attorney, Agent, or Firm*—H. Fredrick Hamann; Harry B. Field

[57] ABSTRACT

Metal matrix composite materials are formed from a reinforcing, submicron-particle material, such as SiC, which is not easily wettable by a matrix metal, such as Al, and therefore cannot be uniformly dispersed in the matrix because the particles agglomerate. A coating 12 of material, such as Si, easily wettable by the matrix metal, is placed on the surface of the particles 10 before mixing the reinforcing particles in the matrix metal.

8 Claims, 1 Drawing Figure

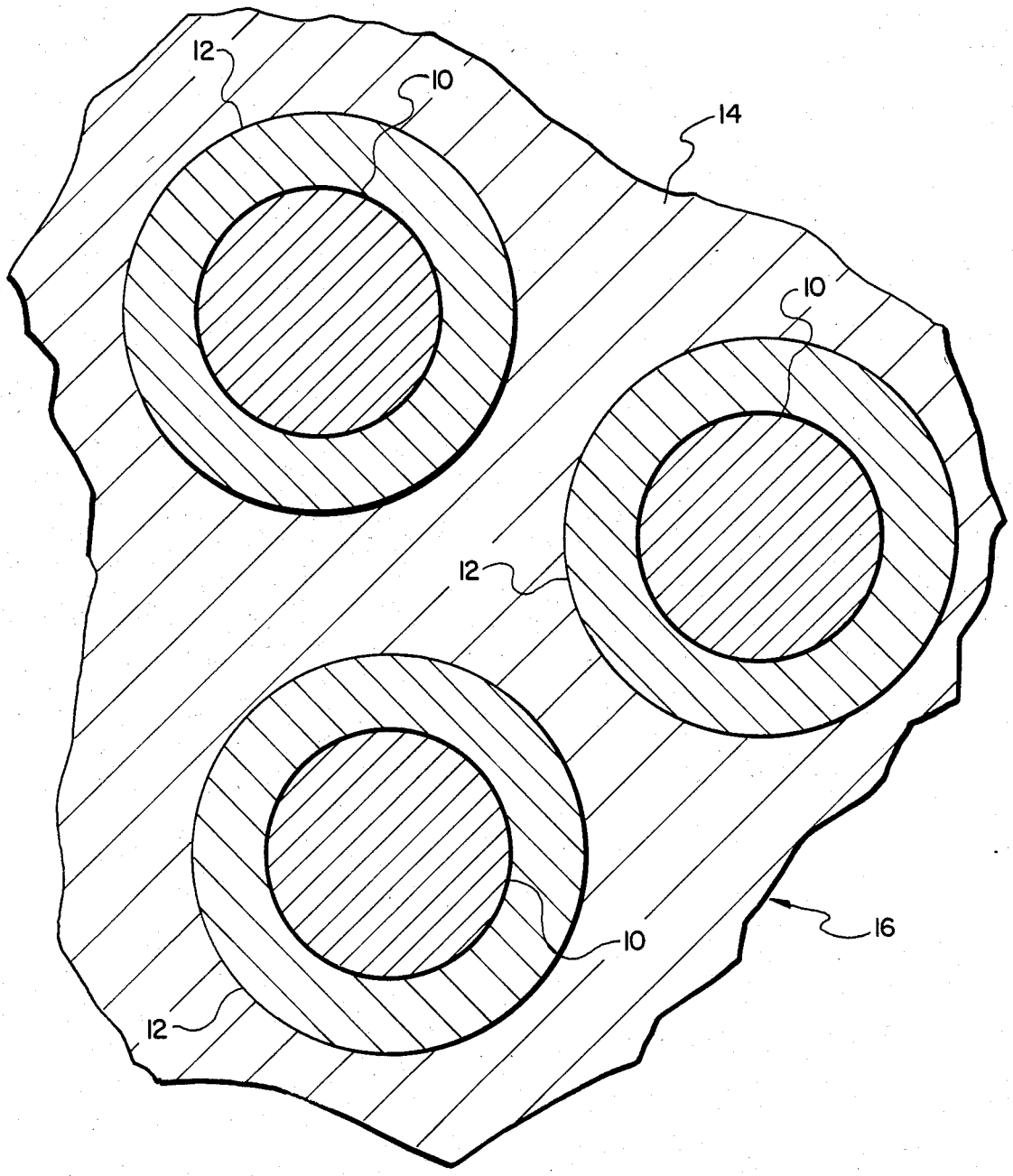
12
10
14
10
12
10
16
12

WETTABLE COATING FOR REINFORCEMENT PARTICLES OF METAL MATRIX COMPOSITE

BACKGROUND OF THE INVENTION

1. Field of the Invention

This invention relates to metallurgy, and especially to metal matrix composite materials containing submicron particles and a method for their formation.

2. Description of the Prior Art

Metal matrix composite materials are generally fabricated for the purpose of improving the qualities of the matrix metal by the inclusion of sub-micron particles in the metal matrix. Usually, the desire is to improve the strength, although it may be desired to modify other qualities.

Very often, the particles may not be wettable by the matrix metal and, if this is so, the particles tend to agglomerate instead of disperse uniformly in the matrix. An example of this is the composite consisting of SiC particles in an Al matrix. The SiC resists wetting by the Al so two methods of dispersion of the SiC particles are used: (1) mechanical entrapment; and (2) high temperature. In mechanical entrapment, the Al does not adhere to the Al and the particles must be above 10 microns in diameter. If high temperature is used, the SiC reacts with the Al to form $Al_4C$ which is very brittle and the smaller the particles of Si Care, the more $Al_4C$ is formed.

To date, attempts to cast most metal matrix composites have been unsuccessful because of non-wetting of the reinforcement particles which, in turn, results in agglomeration of the particles. To disperse the particles, high temperature and excessive agitation have been used, resulting in partial decomposition of the reinforcement particles. High heat applied to SiC particles causes decarburization, reducing the strength of the SiC particles and, as stated before, forms brittle $Al_4C$.

OBJECTS OF THE INVENTION

An object of the invention is to improve the wettability of submicron reinforcing particles used in metal matrix composites.

Another object is to provide metal matrix composites having uniformly dispersed submicron reinforcing particles.

A further object is to provide metal matrix composites having uniformly dispersed submicron reinforcing particles less than 10 microns in diameter.

A further object is to form metal matrix composites which are suitable for casting and for metal powder metallurgy.

Other objects, advantages and novel features of the present invention will become apparent from the following detailed description of the invention when considered in conjunction with the accompanying drawing.

SUMMARY OF THE INVENTION

The objects and advantages of the present invention are achieved by placing a coating on reinforcing submicron particles which are not easily wettable by the metal of the matrix in which they are expected to disperse uniformly to form a metal matrix composite. The coating is formed from a material which is easily wettable by the matrix metal. The preferred process for coating the submicron particles is the chemical vapor deposition (CVD) process.

BRIEF DESCRIPTION OF THE DRAWING

The single FIGURE is a schematic illustration of several coated reinforcement particles in accordance with the invention.

The same elements or parts throughout the FIGURES of the drawing are designated by the same reference characters.

DETAILED DESCRIPTION OF THE PREFERRED EMBODIMENTS

For particularity, the invention will be described with respect to SiC reinforced Al. However, it is not restricted to this composite but can be employed with any composite in which the reinforcing particle material is not easily wettable by the matrix metal, e.g., $Al_2O_3$-reinforced Al. $ThO_2$-reinforced Ni, or $Y_2O_3$-reinforced Al. Suggested coatings would be Si or Al on $Al_2O_3$ and Ni on $ThO_2$ and $Y_2O_3$. The term "submicron" used herein refers to minute particles having a diameter or length ranging from less than a micron to 10 microns or more. The present inventive process is especially useful in the less-than-10 micron range.

If it is desired to incorporate SiC particles in liquid Al to form a metal matrix composite, the SiC particles 10 are coated with a material which is easily wettable by Al, such as Si. This Si coating 12 can be applied, for example, by the CVD (chemical vapor deposition) process in which a stream of gas, such as a silicon halide, is passed through a bed of the SiC particles which may, for example, be 1 micron in diameter, and the entrained particles in the gas stream are passed through a chamber surrounded by a current-carrying coil. The heated gas decomposes onto Si and a halide gas, the Si acting to coat the entrained SiC particles. An initial coating of about 100 atomic layers of Si is formed, which increases in depth with the time allowed for the coating process to proceed. The coating depth should be sufficient to maintain wettability of the reinforcement particles during the incorporation of the particles in the matrix and during the casting stage. Stated in another way, the thickness of the coating should be sufficient to maintain separation (uniform distribution) of the particles during the incorporation and casting stages. The thickness of the minimum coating provided by the CVD process is sufficient.

The thickness of the coating is an empirical fact depending on the time taken for the incorporation and casting stages and the rate of diffusion of the coating material into the surrounding matrix metal. It will vary for different metals and coating materials.

The present invention is also useful for powder metal metallurgy in which Al powder would be mixed with Si-coated, SiC particles, the mixture then being pressed together and sintered. If it is intended to incorporate SiC particles into an aluminum matrix by powder metallurgy, the coating is applied, as described above, on the SiC particles prior to powder mixing, pressing and sintering. The incorporation of the coating reduces the time and the temperature needed to produce bonding between the particles and matrix without resorting to direct reaction of Al with SiC, which decomposes the tiny SiC particles.

The present invention provides a process by which castable metal matrix composites containing reinforcement particles less than 10 microns in size can be formed.

Obviously, many modifications and variations of the present invention are possible in light of the above teachings. It is therefore to be understood that, within the scope of the appended claims, the invention many be practiced otherwise than as specifically described.

What is claimed and desired to be secured by Letters Patent of the United States is:

1. Improved submicron reinforcing particles for use in forming a metal matrix composite in which the material of the particles is not easily wettable by the metal; said improved particles comprising:

reinforcing submicron particles coated on their surfaces with a material which is easily wettable by the matrix metal.

2. Improved particles as in claim 1, wherein:

said particles are less than 10 microns in diameter.

3. Improved particles as in claim 1, wherein:

the coating thickness is sufficient to maintain wettability of said particles during subsequent processing stages during which said metal is in the liquid phase.

4. Improved particles as in claim 1, wherein:

the coating thickness is about 100 atomic layers thick.

5. Improved particles as in claim 1, wherein:

the matrix metal is Al, the particles are formed from SiC and the coating is formed from Si.

6. Improved SiC submicron reinforcing particles for use in forming an Al metal matrix in which the SiC is not easily wettable by the Al metal, said improved particles comprising:

reinforcing submicron particles of SiC coated on their surfaces with a layer of Si, which is easily wettable by the Al metal.

7. Improved particles as in claim 6, wherein:

the coating is approximately 100 atomic layers thick.

8. Improved particles as in claim 6, wherein:

the particles are less than 10 microns in diameter.

* * * * *